United States Patent [19]

Spelten

[11] Patent Number: 5,012,626

[45] Date of Patent: May 7, 1991

[54] STRUCTURAL BAR

[76] Inventor: Hans Spelten, Frankstrasse 21, D-4054 Nettetal 2, Fed. Rep. of Germany

[21] Appl. No.: 481,793

[22] Filed: Feb. 15, 1990

Related U.S. Application Data

[63] Continuation of Ser. No. 418,787, Oct. 3, 1989, abandoned, which is a continuation of Ser. No. 355,149, May 16, 1989, abandoned, which is a continuation of Ser. No. 116,572, filed as PCT EP86/00781 on Dec. 27, 1986, published as WO87/04207 on Jul. 16, 1987, abandoned.

[30] Foreign Application Priority Data

Jan. 8, 1986 [DE] Fed. Rep. of Germany ... 8600280[U]

[51] Int. Cl.[5] ..... E04C 3/07

[52] U.S. Cl. ..... 52/729; 52/930

[58] Field of Search ..... 52/696, 729, 730, 731, 52/732

[56] References Cited

U.S. PATENT DOCUMENTS

| | | | |
|---|---|---|---|
| 2,065,493 | 12/1936 | Greulich . | |
| 3,300,839 | 1/1967 | Lichii | 52/729 X |
| 4,292,782 | 10/1981 | Schaeffer | 52/730 X |

FOREIGN PATENT DOCUMENTS

| | | | |
|---|---|---|---|
| 1058458 | 6/1959 | Fed. Rep. of Germany . | |
| 1125137 | 3/1962 | Fed. Rep. of Germany . | |
| 2364297 | 7/1975 | Fed. Rep. of Germany | 52/729 |
| 2444015 | 3/1976 | Fed. Rep. of Germany . | |
| 8420684 | 12/1984 | Fed. Rep. of Germany . | |
| 36328 | 10/1966 | Finland | 52/729 |
| 1353612 | 1/1964 | France . | |
| 2108984 | 5/1972 | France . | |
| 414118 | 12/1966 | Switzerland | 52/729 |
| 453183 | 10/1967 | Switzerland . | |

*Primary Examiner*—Richard E. Chilcot, Jr.

*Attorney, Agent, or Firm*—Pearne, Gordon, McCoy & Granger

[57] ABSTRACT

A structural bar comprises two chords and an upright web interconnecting such chords. The web is shaped trapazoidal with bulges extending alternatingly to the one or the other longitudinal side or rim of the structural bar. Any kinks or breaks of the trapezoidal shaped web are avoided. The chords are connected to the edges of the web or webs by means of continuous weld or by welds of limited length which provide in total a continuous weld line at least in the longitudinal direction of the structural bar. Thus, the load capacity or supporting capacity of the structural bar can be determined exactly so that over-dimensioning is to be avoided.

12 Claims, 2 Drawing Sheets

STRUCTURAL BAR

Figure 1:
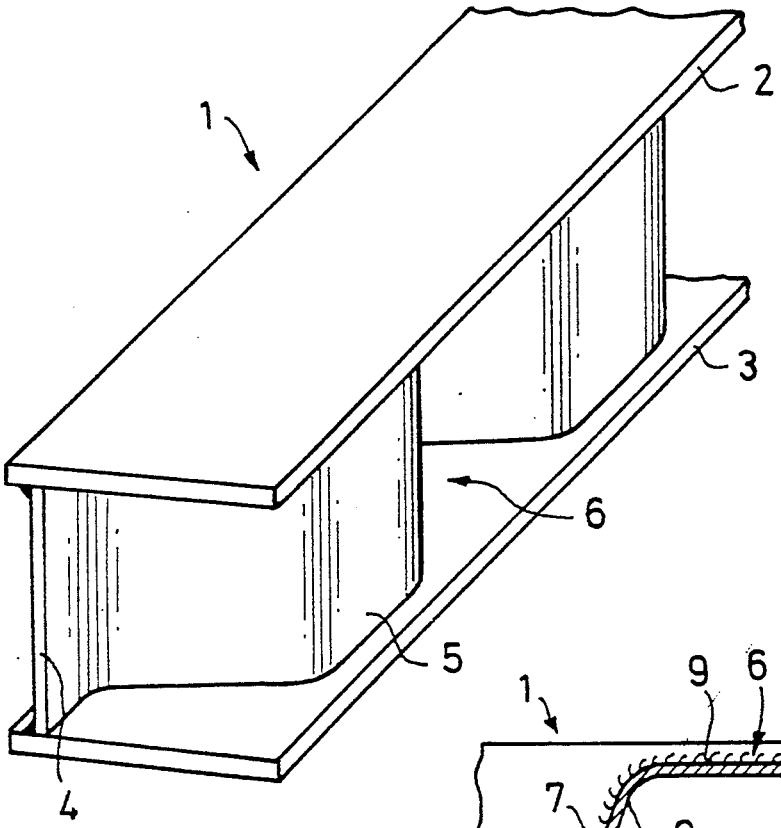

This is a continuation of Ser. No. 418,787, filed Oct. 3, 1989, which in turn is a continuation of Ser. No. 355,149, filed May 16, 1989, which is a continuation of Ser. No. 116,572, filed as PCT EP86/00781 on Dec. 27, 1986, published as WO87/04207 on Jul. 16, 1987 now abandoned.

The invention relates to a structural bar having two chords and an upright web interconnecting said chords so that one chord is the upper and the other the lower chord of said structural bar, said web comprising bulges alternatingly extending in the direction to the one and the other longitudinal rim or lateral edge of said bar.

Structural bars of this kind are for instance known from the West German utility model publication DE-GM No. 84 20 684.5. In the embodiment of FIG. 3 of this prior art publication the web is connected to both chords by means of local welds of limited lengths which are provided at the outside portions of said web. In accordance with the embodiment of FIG. 2 of this prior art publication the web is connected to the chords by means of a double weld which is provided at the sections of said web between said bulges thereof and having a limited length.

Even though such structural bars or metal beams can be used for a number of applications it has been found out in practice that it is not possible to exactly calculate the load which can be applied to such bars so that they have to be over-dimensioned. However, over-dimensioning results in an enlarged weight of the structural bars so that they are not very economic in handling and in practical use.

It is the object of the present invention to improve the structural bars known from DE-GM No. 84 20 684.5 thus so that the loading capacity thereof can be exactly calculated so that unnecessary over-dimensioning or over-sizing can be avoided.

Accordingly, the present invention provides a structural bar in which both chords are connected to the upper and lower end of the web provided between said chords or connected to said chord along the length thereof continuously and for instance without interruptions. Thus, a weight-saving construction for a structural bar is obtained even if said bar is formed of metal like, steel. Such weight-saving construction structural bar can be used universally in all static systems and for all types of loads without the necessity of undue over-dimensioning or over-sizing. Therefore, it is possible to produce such structural bars in a simple and advantageous manner and to save enormous amounts of material and masses and weights. Such structural bars can be produced everywhere without complicated production means so that they can also be produced in developing countries in an economic manner and with good quality.

For instance, the chords, if formed of metal, can be connected to said web, which in this embodiment is also formed of metal, by means of at least one continuous weld which is provided at least at one side or in alternating sections on one or both sides of said web. A further embodiment provides that the chords are connected to the web by means of two opposite welds which are provided at both sides of said web and which are continuous and for instance uninterrupted.

In accordance with another feature of the invention the web comprises a flat bar material which is bent into the bulged shape so that its sections extend in angular positions to one another and are interconnected by circular or curved portions or curvatures. Thus, acute connections or corners are avoided which could result in alterations of the material structure and therefore in weakenings in the corner portions of the bulges which will have the result that also the connection between said chords and said web would be weakened and could become uncertain. In accordance with the present invention such uncontrollable weakenings can be avoided and it is possible to obtain even properties of the structural bar over the entire length thereof and to apply welds or weld lines for the connection between the central web and the chords interconnected by such web without the necessity of using complicated production and controlling means or machines.

With the invention it is possible to produce structural beams, for instance formed of metal, wherein the loading thereof can be examined and calculated without difficulty so that the load capacity thereof can be calculated exactly. It is possible to produce structural bars having straight, angular, conically extending or otherwise bent sections in which the cross section of said web is substantially trapezoidal. The structural bars can be produced from aluminium or steel or other suitable material wherein in each case a weight-saving construction is obtained. Perfect automatic production is possible. The curved connections between the trapezoidal or wave-like sections of the web guaranty over the entire length even properties of the structural bar and therefor an even strength. Therefore, the structural bars of the present invention can be used for all kinds of loads in an optimum manner. The cross section can be symmetric or even asymmetric. The upper and lower chords can therefore be arranged parallel to one another or even in an angle or inclined to one another.

The bulges of the web form with the chords an angle between 10° to 170° and preferably between 60° to 120°. The sides of flanks of the bulges extend in an angle or between 1° to 89° to the longitudinal axis of the structural bar or the web thereof.

In the simplest embodiment the webs of the structural bar comprise of band or stripe material or another flat bar. However, they can comprise also of profile material having an open or closed profile which is provided in an optimum arrangement. The flat material can for instance be made by hot rolling a metal block.

In accordance with the present invention the deformation and therefore the load capacity of the structural bars can be detected or proved in a reliable manner, it is possible to dimension such bars in the best manner. In addition, such bars can be produced in an economic manner with all possible cross sections and/or profiles.

Figure 2:
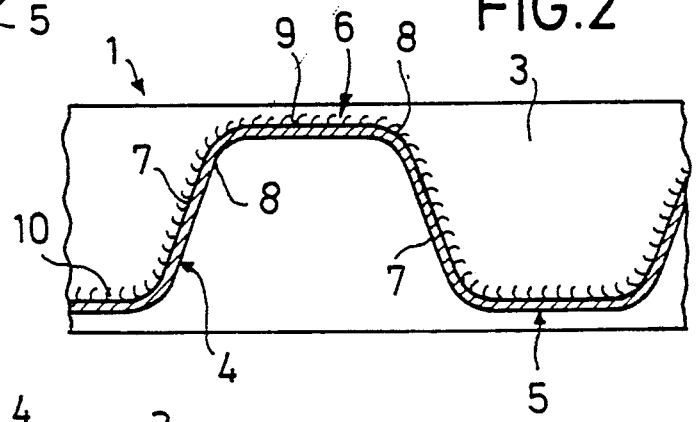
Figure 3:
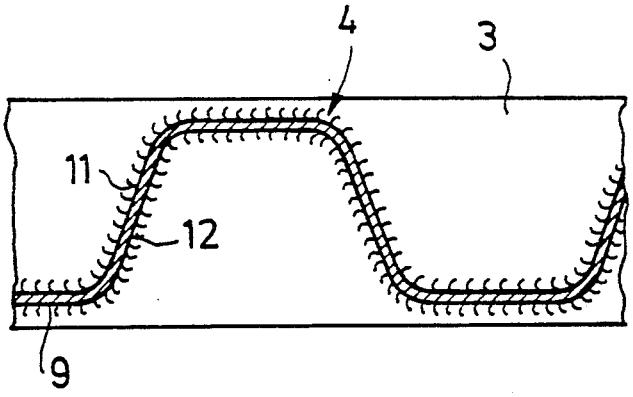

In the drawings several embodiments of the structural bar of the present invention are schematically shown, wherein FIG. 1 is a perspective view of one end of the structural bar according to one embodiment of the present invention, FIG. 2 is a horizontal partial longitudinal section of the structural bar of FIG. 1 and FIG. 3 to 9 are horizontal partial sections as in FIG. 2 of other embodiments of the structural bar of the present invention.

The structural bar (1) has an upper chord (2) and a lower chord (3) which are interconnected by an upright web (4) as shown in FIG. 1. Even though in FIG. 1 the chords (2 and 3) extend parallel to one another and substantially normal to web (4) they can also extend in an angle different from 90° to web (4) so that they are not parallel to one another. The angle of said chords to web (4) can be between 10° and 170° and is preferably within between 60° and 120° and most preferably between 75° and 105°.

In the embodiment of FIG. 1 and 2 the chords (2 and 3) comprise of band material or flat bar material. However, they can comprise also of known profile material having U-shaped, H-shaped, angular or other cross section. Also, they can comprise of closed profile material having circular, rectangular or other hollow cross section.

Web (4) is in its longitudinal direction thus bent that it forms bulges (5 and 6) extending alternatively into the direction of the one or the other longitudinal rim or lateral edge of said structural bar (1). The flanks (7) or sides of such bulges extend in an angle of between 1° and 89° to the longitudinal axis of the structural bar (1), while the section (9) interconnecting the flanks (7) of each bulge (5 and 6) extends substantially in the longitudinal direction of said structural bar (1).

The transitions or junctions between the flanks (7) and section (9) of each bulge have the shape of a curvature or curved portion (8) which is bent along a radius which is preferably at least as large as one and a half of the thickness of the web (4).

Thus, sharp-edged or acute junctions between the bulges (5 and 6) and the portions thereof are avoided which could result in un-controllable alterations of the material properties of web (4).

In accordance with FIG. 2, the chords (2 and 3) are welded to the upper and lower edges of web (4, respectively), by means of a continuous and uninterrupted weld (10). In the embodiment of FIG. 3 the connection is obtained by two uninterrupted welds (11 and 12) provided on the opposite sides of web (4). It is to be recognized that due to the curvatures (8) between the sections (7 and 9) of each bulge (5 and 6) the respective weld lines (10, 11 and 12, respectively), extend evenly and without interruptions so that they can also be produced evenly without any difficulties.

Figure 4:
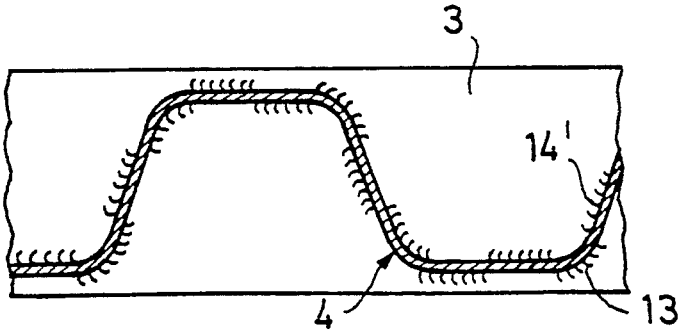

In the embodiment of FIG. 4 welds (13 and 14') of limited length are alternatively provided at the one or the other side of web (4) which, however, in total form a continuous connection between web (4) and chords (2 and 3).

Figure 5:
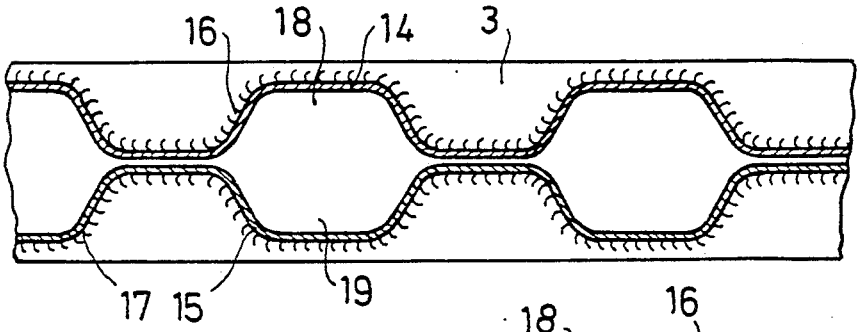
Figure 6:
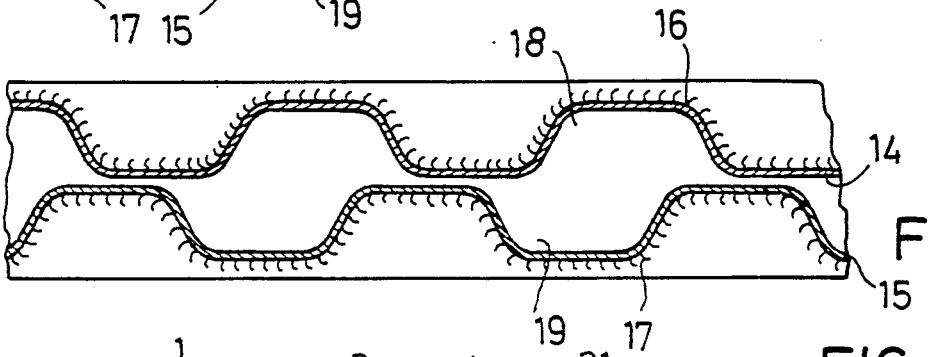

While in the embodiments of FIG. 1 to 4 the structural bar (1) has one web (4) comprising of flat bar material shaped by bending, in the embodiments of FIG. 5 and 6 the chords (2 and 3) are interconnected by means of two parallel webs (14 and 15) which are connected to chords (2 and 3) by means of welds (16 and 17, respectively), which being welded from the outside. In the embodiment of FIG. 5 the bulges (18 and 19) of webs (14 and 15) are opposite to one another while in the embodiment of FIG. 6 such bulges are displaced to one another. Also in these embodiments the webs (14 and 15) comprise of flat bar material and are bent to the desired shape so that no sharp or acute edges appear at those webs.

It is also possible to interconnect chords (2 and 3) by means of more than two webs comprising of shaped flat bar material.

The curvatures (8) are thus shaped that the radius thereof is at least one and a half of the thickness of the material of such webs (4 and 14, 15, respectively). Thus, weakenings of web material at the deflections of the continuous webs can be avoided.

It is an important feature of the invention that the webs (4 and 14, 15, respectively), comprise of uninterrupted or continuous flat bar, sheet, band or strip material and that such webs are trapezoidal shaped having rounded curvatures (8) because otherwise calculation of the load capacity or possible loading of the structural bar and thus a best dimensioning or sizing thereof would not be possible.

Figure 7:
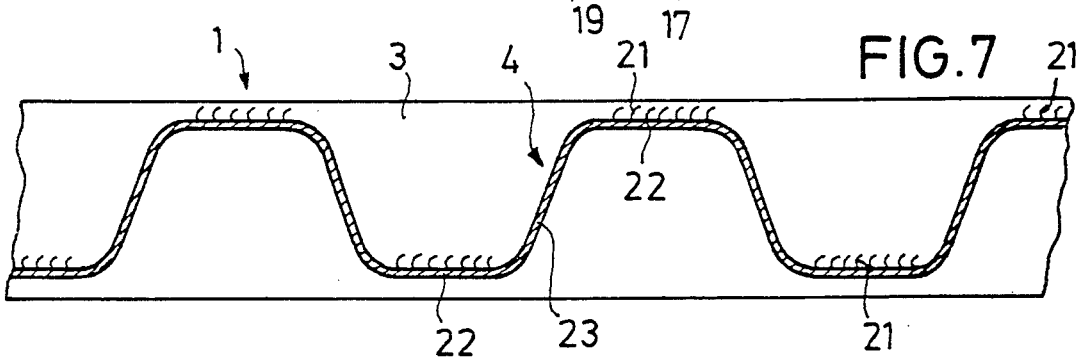
Figure 8:
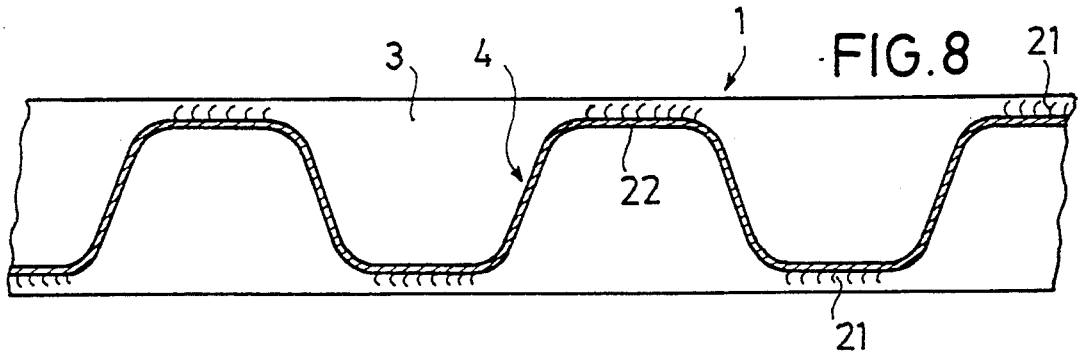
Figure 9:
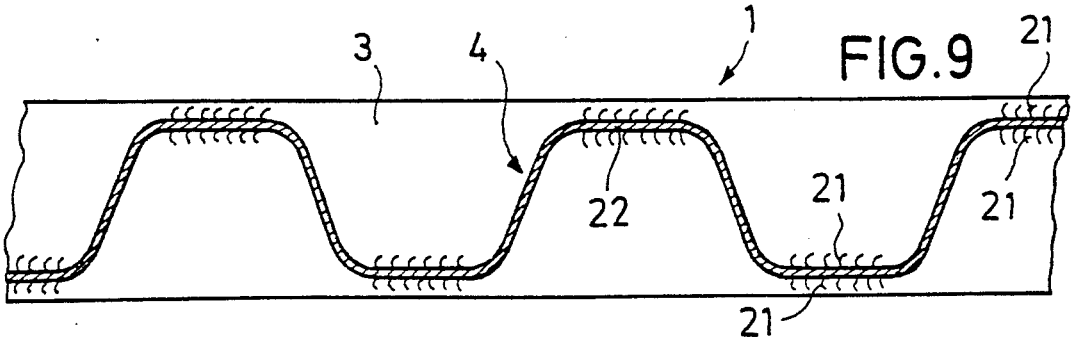

It has been found that the load capacity of structural bars produced in accordance with the present invention can be calculated also if the trapezoidal bent webs are connected with the chords of such structural bars only partly, i.e. only in certain sections. FIG. 7 to 9 disclose such embodiments.

In accordance with FIG. 7 welds (21) of limited length are provided on one side of the sections (22) of the trapezoidal web (4) which extend in the longitudinal direction of the structural bar (1). In this embodiment the web (4) is accordingly connected to the chords (2 and 3) only by means of such welds (21) of limited length. The inclined sections (23) of web (4) are not connected to chords (2 and 3). It has been found that also for such structural bars the supporting or load capacity can be calculated so that such structural bars can comprise of flat bar material and can be produced in a weight-saving construction.

In accordance with FIG. 8 the web (4) extending upright between the chords (2 and 3) is similar as in FIG. 7 welded to chords (2 and 3) only at the straight sections (22) extending in the longitudinal direction of the structural bar (1). However, in this embodiment the welds (21) of limited length are provided alternatingly at the one and the other side of web (4).

Also in the embodiment of FIG. 9 only the sections (22) of web (4) extending in the longitudinal direction of the structural bar (1) are connected to chords (2 and 3). However, in this embodiment welds (21) are provided at both sides of sections (22).

Even though the invention has been explained herein before for structural bars comprising of metal, such structural bars can also comprise of plastics or of a combination of plastics and wood or plastics and metal. It is in any case essential that the trapezoidal shaped webs (4) comprise of uninterrupted or continuous band or strip material and do not contain any kinks or breaks which would reduce the strength thereof. In other words, the material of the web should have even properties over the entire length of the structural bar.

If the parts of the structural bar comprise of plastics and/or wood or if a combination with metal is provided, such parts are interconnected by means of a suitable adhesive.

I claim:

1. A structural bar having a longitudinal length and a lateral width comprising separate chord and web elements welded together to provide the structural bar with uniform load bearing properties, said chord elements comrpising weldable metal upper and lower chords extending along the longitudinal length and lateral width of the structural bar, each of said chords having a substantially uniform thickness extending along the length and width of the structural bar, said web element comprising a flat plate of weldable metal having a substantially uniform height extending between upper and lower extremities respectively connected by continuous welds to said upper and lower chords and bulges extending in alternating lateral directions toward opposite lateral edges of said structural bar, said flat plate having said bulges therein arranged in an open-bottomed trapezoidal shape, and said bulges comprising angular sections of said flat plate joined by curved portions of said flat plate, said flat plate comprising a substantially continuous and uninterrupted strip of metal having a thickness and the curved portion thereof having a radius of curvature at each curved portion at least as large as $1\frac{1}{2}$ times the thickness of the strip of metal, whereby said web is free of sharp-edged or acute junctions between angular sections of said bulges which tend to cause uncontrollable variations in the properties of the web and the load capacity of the structural bar.

2. The structural bar of claim 1, wherein each of said continuous welds is an uninterrupted weld.

3. The structural bar of claim 1, wherein said chords each are connected with said web by means of two opposing continuous welds.

4. The structural bar of claim 1, wherein said bulges of said web are inclined to said chords at an angle of between 10° to 170°, in longitudinal section and in lateral cross-section.

5. The structural bar of claim 1, wherein said angular sections include bulge side sections extending at an angle of between 1° to 89° to the longitudinal length of said structural bar.

6. The structural bar of claim 1, wherein said web includes a second strip of metal parallel to said first mentioned strip of metal.

7. The structural bar of claim 1, wherein said angular sections include bulge side sections and bulge longitudinal sections which are joined by said curved portions, and said bulge side sections extend substantially transversely to the longitudinal length of said structural bar and said bulge longitudinal sections extend substantially along the longitudinal length of said structural bar.

8. The structural bar of claim 7, wherein each of said bulge side sections extends a transverse distance across substantially the entire lateral width of said structural bar.

9. The structural bar of claim 8, wherein each of said bulge longitudinal sections extends along the longitudinal length of said structural bar a longitudinal distance substantially equal to said transverse distance.

10. The structural bar of claim 9, wherein each of said adjacent bulge side sections extends transversely across the lateral width of said structural bar toward one another for connection by said curved portions to an associated one of said bulge longitudinal sections to provide said web with said open-bottomed trapezoidal shape.

11. The structural bar of claim 1, wherein said web has opposite sides and a thickness therebetween, and said continuous weld connecting one of said web extremities and chords is an uninterrupted weld which extends along one side of the web along the longitudinal length of the structural bar.

12. The structural bar of claim 1, wherein said web has opposite sides and a thickness extending therebetween, and said continuous weld connecting one of said web extremities and chords is an interrrupted weld which alternately extends along one side and then the other side of said web along the longitudinal length of the structural bar.

* * * * *